US010102961B2

(12) United States Patent
Kim et al.

(10) Patent No.: US 10,102,961 B2
(45) Date of Patent: Oct. 16, 2018

(54) LAMINATED INDUCTOR

(71) Applicant: SAMSUNG ELECTRO-MECHANICS CO., LTD., Suwon-si, Gyeonggi-do (KR)

(72) Inventors: Ju Hyun Kim, Suwon-si (KR); Yun Suk Oh, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 80 days.

(21) Appl. No.: 15/251,607

(22) Filed: Aug. 30, 2016

(65) Prior Publication Data

US 2017/0186526 A1 Jun. 29, 2017

(30) Foreign Application Priority Data

Dec. 29, 2015 (KR) ..... 10-2015-0188569

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 41/04*** | (2006.01) |
| ***H01F 17/00*** | (2006.01) |

(52) U.S. Cl.

CPC ..... *H01F 27/2804* (2013.01); *H01F 5/00* (2013.01); *H01F 17/0013* (2013.01); *H01F 27/29* (2013.01); *H01F 27/292* (2013.01); *H01F 41/043* (2013.01); *H01F 2027/2809* (2013.01)

(58) Field of Classification Search

CPC ..... H01F 5/00; H01F 27/00–27/36

USPC ..... 336/65, 83, 200, 206–208, 232

See application file for complete search history.

(56) References Cited

U.S. PATENT DOCUMENTS

| | | | | |
|---|---|---|---|---|
| 5,392,019 A * | 2/1995 | Ohkubo | ..... | H01F 17/0013 333/185 |
| 6,124,779 A | 9/2000 | Yamamoto | | |
| 6,154,114 A | 11/2000 | Takahashi | | |
| 6,541,968 B1 * | 4/2003 | Tokuda | ..... | G01R 33/028 324/258 |

(Continued)

FOREIGN PATENT DOCUMENTS

| | | |
|---|---|---|
| JP | 10-172831 A | 6/1998 |
| JP | 2001-76928 A | 3/2001 |

(Continued)

OTHER PUBLICATIONS

Notice of Office Action dated Apr. 19, 2017, in corresponding Korean Patent Application No. 10-2015-0188569, with English language translation.

*Primary Examiner* — Tuyen Nguyen

(74) *Attorney, Agent, or Firm* — McDermott Will & Emery LLP

(57) ABSTRACT

A laminated inductor includes a ceramic body, a coil part including a plurality of first internal electrodes including connection portions at both end portions thereof and disposed in the ceramic body in a spiral shape, a second internal electrode including a lead electrode portion exposed to the outside of the ceramic body, having an internal area smaller than that of the first internal electrode, and disposed on or below the coil part in a spiral shape, and a connection electrode portion extended from the second internal electrode in a direction opposite to the lead electrode portion.

10 Claims, 7 Drawing Sheets

(56) References Cited

U.S. PATENT DOCUMENTS

| | | | | |
|---|---|---|---|---|
| 7,327,207 | B2 * | 2/2008 | Asakawa | H01F 17/0013 333/175 |
| 2007/0296536 | A1 * | 12/2007 | Odahara | H01F 17/0013 336/200 |

FOREIGN PATENT DOCUMENTS

| | | | |
|---|---|---|---|
| JP | 2002-151331 | A | 5/2002 |
| JP | 2005-311035 | A | 11/2005 |
| KR | 10-0534169 | B1 | 12/2005 |
| KR | 10-2012-0047631 | A | 5/2012 |
| KR | 10-1153656 | B1 | 6/2012 |

* cited by examiner

LAMINATED INDUCTOR

CROSS-REFERENCE TO RELATED APPLICATION

This application claims the benefit of priority to Korean Patent Application No. 10-2015-0188569, filed on Dec. 29, 2015 with the Korean Intellectual Property Office, the entirety of which is incorporated herein by reference.

BACKGROUND

The present disclosure relates to a laminated inductor.

An inductor, an important passive device configuring an electronic circuit together with a resistor and a capacitor, may be used as a component configuring an LC filter removing noise or as a component configuring an LC resonance circuit.

An inductor may be manufactured by winding or printing a coil around a ferrite core and forming electrodes at both ends of the core, or by printing an internal conductor on a magnetic or dielectric sheet and then laminating the sheet.

The inductor may be classified according to the structure thereof. For example, the inductor may be classified as a winding inductor, a thin film inductor, a laminated inductor, and the like. Among them, laminated inductors have been widely used.

According to the related art, a winding inductor is conventionally manufactured by winding a conductive coil around a core formed of a magnetic material.

Since, in the winding inductor, a ferrite core is manufactured by compressing and molding ferrite powder and sintering the molded ferrite powder, mass-production of the winding inductor may be difficult, and the winding inductor may not be suitable for use in a small electronic device due to the large volume of the completed product.

Therefore, use rate of the laminated inductor has increased. The laminated inductor as described above is manufactured in a form of a laminate of a plurality of magnetic sheets or ceramic sheets formed of a dielectric material having low permittivity, that is, a ceramic body.

A coil-shaped metal pattern may be formed on the ceramic sheet, and coil-shaped metal patterns formed on respective ceramic sheets may be connected to metal patterns formed on other ceramic sheets through a conductive via.

The coil-shaped metal patterns may be sequentially connected to each other by the conductive via, thereby forming a coil with a spiral structure.

Some of the coil-shaped metal patterns may have a lead electrode portion led to an outer surface of the ceramic body to thereby be electrically connected to an external electrode.

Recently, a size of the laminated inductor has been decreased in accordance with miniaturization of electronic products, and thus, a size of the metal pattern configuring an interior of the laminated inductor has also been decreased.

As the size of the metal pattern has been decreased in accordance with miniaturization of electronic products, a physical influence may be relatively increased during printing of the metal pattern or laminating of the ceramic sheets. Therefore, it may be difficult to precisely adjust other characteristics of the laminated inductor, including inductance thereof, unlike the related art.

Further, since the kind of device to be required depending on various products is various and is sub-divided, there is a need to develop various sub-models by adjusting an internal design of the laminated inductor implementing characteristics, and at the same time, there is a need to secure reliability of the laminated inductor.

SUMMARY

An aspect of the present disclosure provides a laminated inductor capable of securing reliability while precisely adjusting other characteristics of the laminated inductor, including inductance.

According to an aspect of the present disclosure, a laminated inductor includes: a ceramic body; a coil part including a plurality of first internal electrodes including connection portions at both end portions thereof and disposed in the ceramic body in a spiral shape; a second internal electrode including a lead electrode portion exposed to the outside of the ceramic body, having an internal area smaller than that of the first internal electrode, and disposed on and below the coil part in a spiral shape; and a connection electrode portion extended from the second internal electrode in a direction opposite to a direction toward the lead electrode portion.

According to another aspect of the present disclosure, a laminated inductor includes: a ceramic body of which external electrodes are disposed on both sides; a coil part including a plurality of first internal electrodes having first and second connection portions disposed at both end portions thereof and a first inductance portion having a coil shape; and a second internal electrode disposed on or below the coil part and including a second inductance portion and a connection electrode portion, wherein an area of the second inductance portion is smaller than that of the first inductance portion, and the connection electrode portion is extended from the second inductance portion to a position corresponding to the first or second connection portion adjacent thereto.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
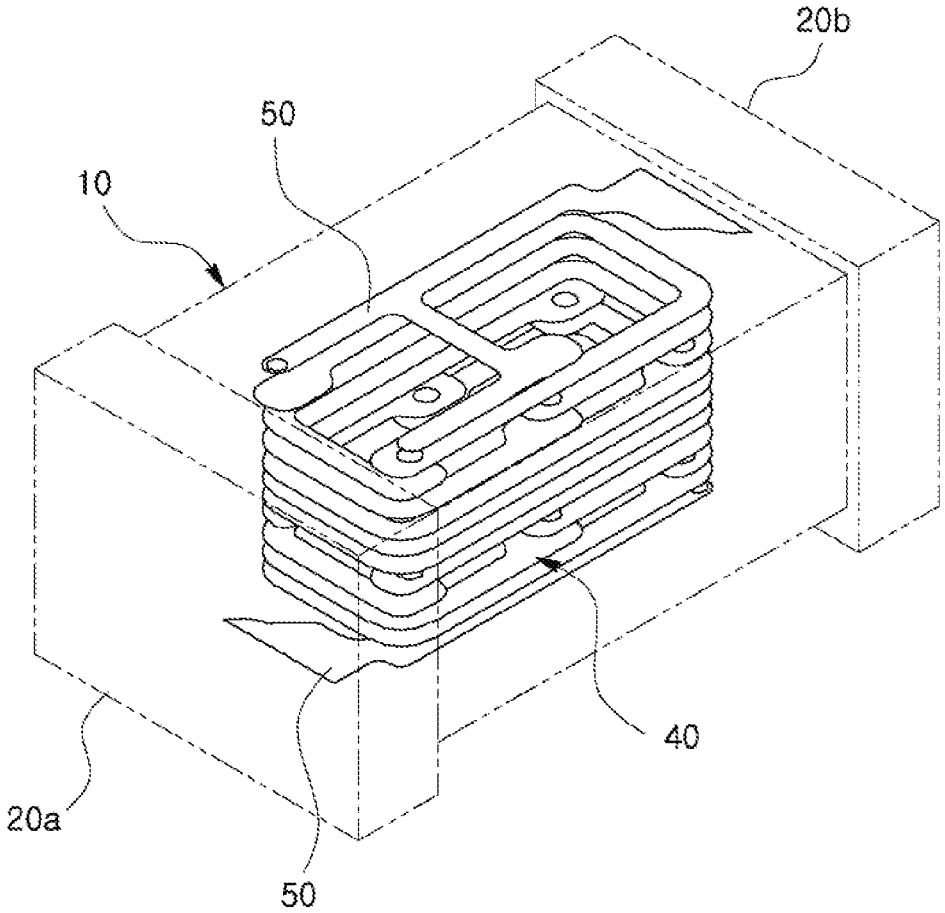
FIG. 1 is a perspective view schematically illustrating a laminated inductor according to an exemplary embodiment in the present disclosure.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Figure 2:
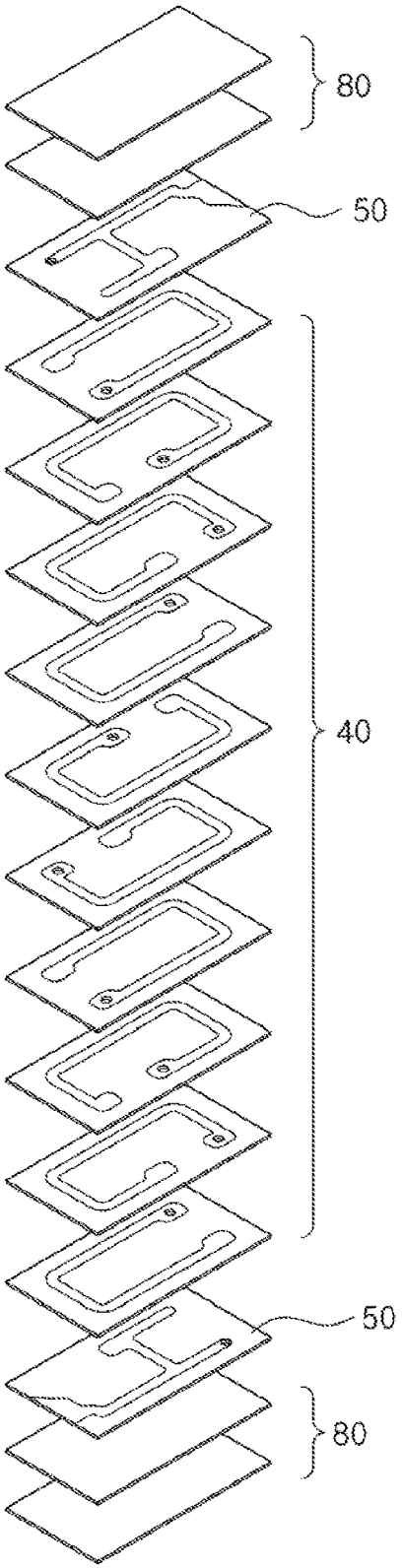
FIG. 2 is an exploded perspective view schematically illustrating the laminated inductor according to the exemplary embodiment.

FIG. 1 is a perspective view schematically illustrating a laminated inductor according to an exemplary embodiment in the present disclosure, and FIG. 2 is an exploded perspective view schematically illustrating the laminated inductor according to the exemplary embodiment.

A structure of the laminated inductor according to the exemplary embodiment of the present disclosure will be described with reference to FIGS. 1 and 2.

The laminated inductor according to the exemplary embodiment may include a ceramic body 10 and external electrodes 20*a* and 20*b*.

A coil part 40 and a lead part 50 may be disposed in the ceramic body 10.

First internal electrodes may be sequentially laminated in the coil part 40, and respective first internal electrodes may be electrically connected to each other through a via, thereby configuring a coil. If necessary, inductance of the laminated inductor may be increased by sequentially and repeatedly laminating the first internal electrodes.

The lead part 50 may be disposed on and below the coil part 40. The lead part 50 may include a second internal electrode. One end portion of the second internal electrode of the lead part 50 may be electrically connected to the external electrode 20*a* or 20*b* and the other end portion thereof may be electrically connected to the first internal electrode.

The first and second internal electrodes may be formed on ceramic layers using a conductive paste, or may be formed by a deposition method, or the like.

A cover part 80 on which an internal electrode is not formed may be formed on and below the lead part 50. The cover part 80 may serve to protect the laminated inductor from external impact or conductive foreign materials.

Figure 3:
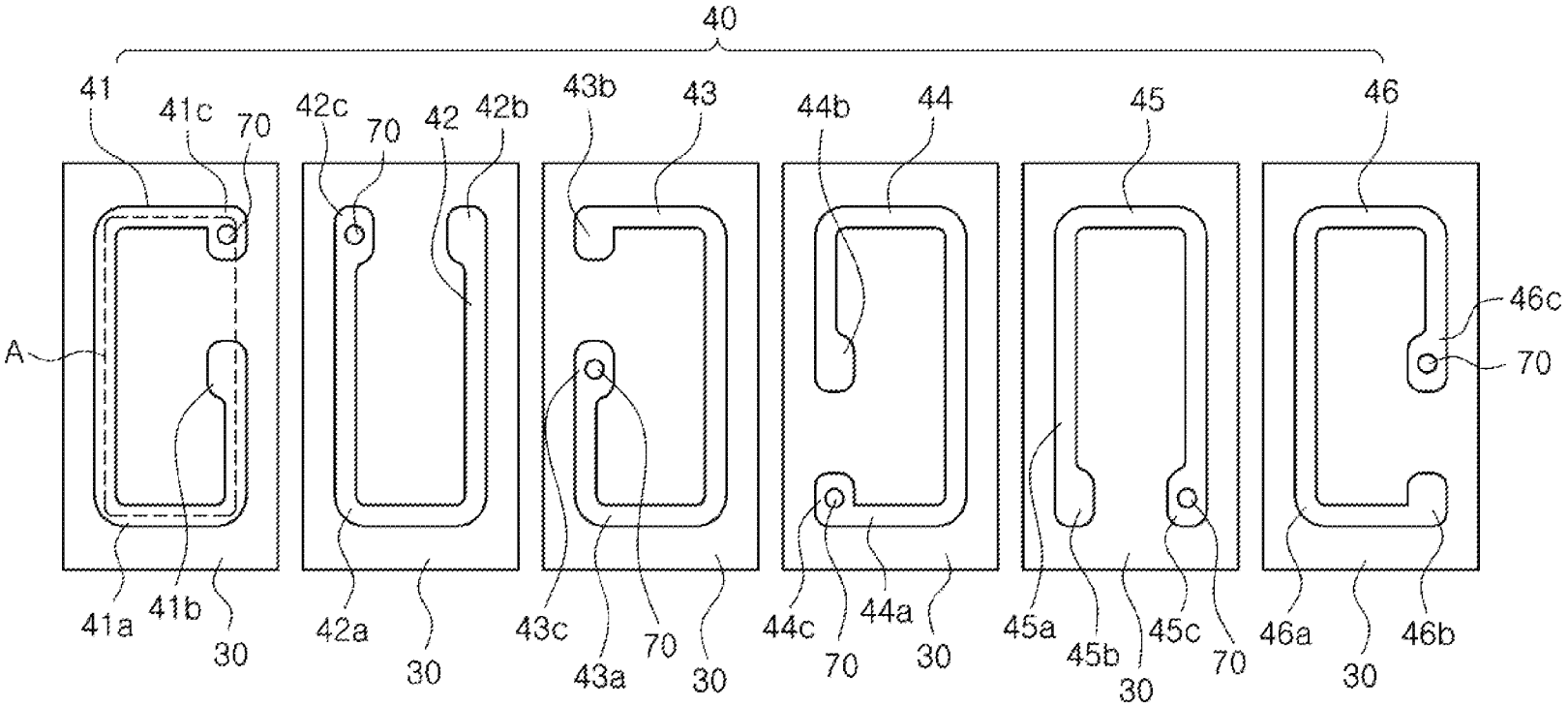
FIG. 3 schematically illustrates plan views of first internal electrodes.

FIG. 3 schematically illustrates plan views of first internal electrodes 41 to 46.

The first internal electrodes 41 to 46 may be formed on ceramic layers 30 to have a spiral or coil shape using a conductive material.

The first internal electrodes 41 to 46 may include first inductance portions 41*a* to 46*a*, first connection portions 41*b* to 46*b*, and second connection portions 41*c* to 46*c*, respectively. The first and second connection portions 41*b* to 46*b* and 41*c* to 46*c* may be referred to as a connection portion.

The first internal electrodes 41 to 46 may be sequentially laminated, thereby configuring the coil. In this case, the first connection portions 41*b* to 46*b* may be respectively connected to adjacent second connection portions 41*c* to 46*c* disposed therebelow through a via 70. For example, in a case in which the first internal electrode 42 is laminated on the first internal electrode 41, the second connection portion 41*c* and the first connection portion 42*b* may be electrically connected to each other through the via 70. If the first internal electrode 41, 42, 43, 44, 45, or 46 is an uppermost layer or lowermost layer of the core part 40, the first connection portion 41*b*, 42*b*, 43*b*, 44*b*, 45*b*, or 46*b* or the second connection portion 41*c*, 42*c*, 43*c*, 44*c*, 45*c*, or 46*c* may be connected to a second internal electrode to be described below.

The first inductance portions 41*a* to 46*a* may have a tetragonal shape with a pair of long sides and a pair of short sides as a tetragon A represented by a dotted line in FIG. 3. In this case, an internal area of each of the first inductance portions 41*a* to 46*a* may mean an area of the tetragon A.

As described above, in a case in which the first internal electrodes 41 to 46 are sequentially laminated to configure the coil, the tetragon A may mean an internal area formed by the coil. That is, inductance of the laminated inductor may be implemented depending on the internal area of the first internal electrodes 41 to 46.

Further, assuming a plan view seen from a top surface after sequentially laminating the first internal electrodes 41 to 46 as described above, the connection portions 41*b* to 46*b* and 41*c* to 46*c* may be positioned at a plurality of positions in the plan view. For example, in a case in which the first internal electrodes 41 to 46 have a tetragonal shape with the pair of long sides and the pair of short sides, the connection portions 41*b* to 46*b* and 41*c* to 46*c* may be positioned at a total of six positions, that is, corners of the tetragon, and central portions of the long sides thereof.

A case in which the coil is formed using six kinds of first internal electrodes is illustrated in FIG. 3, and among the first internal electrodes, a first internal electrode having a U or ∩ shape may be included.

Figure 4:
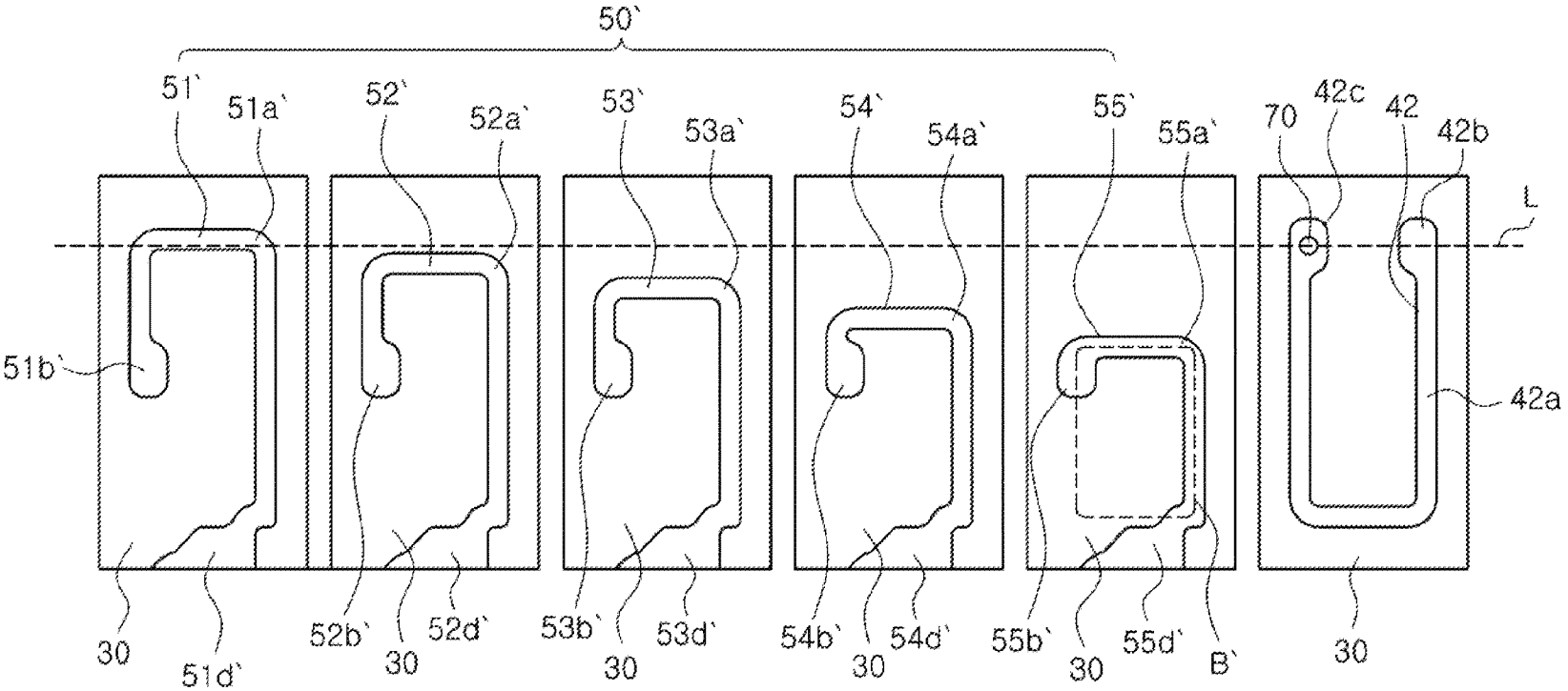
FIG. 4, which schematically illustrates plan views of second internal electrodes included in a laminated inductor according to the related art, is a view comparing the presence or absence of connectivity with a U-shaped first internal electrode.

FIG. 4, which schematically illustrates plan views of second internal electrodes included in a laminated inductor according to the related art, is a view comparing the presence or absence of connectivity with a U-shaped first internal electrode.

Second internal electrodes 51' to 55' may include second inductance portions 51*a*' to 55*a*', connection portions 51*b*' to 55*b*', and lead electrode portions 51*d*' to 55*d*'.

The second inductance portions 51*a*' to 55*a*' may have a tetragonal shape with a pair of long sides and a pair of short sides as a tetragon B' represented by a dotted line in FIG. 4. In this case, an internal area of each of the second inductance portions 51*a*' to 55*a*' may mean an area of the tetragon B'.

It may be appreciated that internal areas of the second internal electrodes 51' to 55' of FIG. 4 are different from each other. That is, inductance of the laminated inductor may be adjusted by selecting one from the second internal electrodes 51' to 55' of FIG. 4 to dispose the selected second internal electrode on or below the coil part 40.

For example, inductance of the laminated inductor may be further decreased by selecting one among the second internal electrodes 52' to 55' as compared to a case of selecting the second internal electrode 51'.

According to the present disclosure, the internal area is decreased, which means that one portion of the inductance portion of the second internal electrode is disposed to pass through the same path as that of the inductance portion of the first internal electrode, and another portion thereof is disposed to pass through the interior of the inductance portion of the first internal electrode.

That is, inductance of the laminated inductor may be finely adjusted by adjusting the internal areas of the second internal electrodes 51' to 55' as described above.

In the laminated inductor, in order to adjust inductance, the number of turns of the coil may be adjusted by increasing the number of first internal electrodes laminated in the coil part 40. However, in this case, the number of turns may be increased, and thus inductance may be rapidly increased.

Therefore, inductance of the laminated inductor may be finely adjusted by adjusting the internal area of the second internal electrode in order to prevent inductance from being rapidly increased as described above.

However, when the internal area of the second internal electrode is adjusted as described above, connectivity with the first internal electrode may be decreased, and thus reliability may be deteriorated.

The first internal electrode 42 having the U shape is illustrated in FIG. 4, and a dotted line L is an extended line of the first or second connection portion 42*b* or 42*c* on the plan view.

Referring to FIG. 4, when the first internal electrode 42 is the uppermost layer or lowermost layer of the coil part 40 and the second internal electrode 51' is the second internal electrode connected to the first internal electrode 42, since the second internal electrode 51' is formed at a position corresponding to the first or second connection portion 41*b* or 41*c*, the first and second internal electrodes 42 and 51' may be connected to each other without difficulty.

However, when the second internal electrode 52', 53', 54' or 55' is used as the second internal electrode to be connected to the first internal electrode 42, there is no contact portion between the first and second internal electrodes, and thus connecting the first and second internal electrodes to each other may be problematic.

Although a case in which a connection problem of the first internal electrode having the U shape is illustrated in FIG. 4 by way of example, in a case of using the first internal electrode having another shape in addition to the U shape, the above-mentioned problem may also occur.

Figure 5:
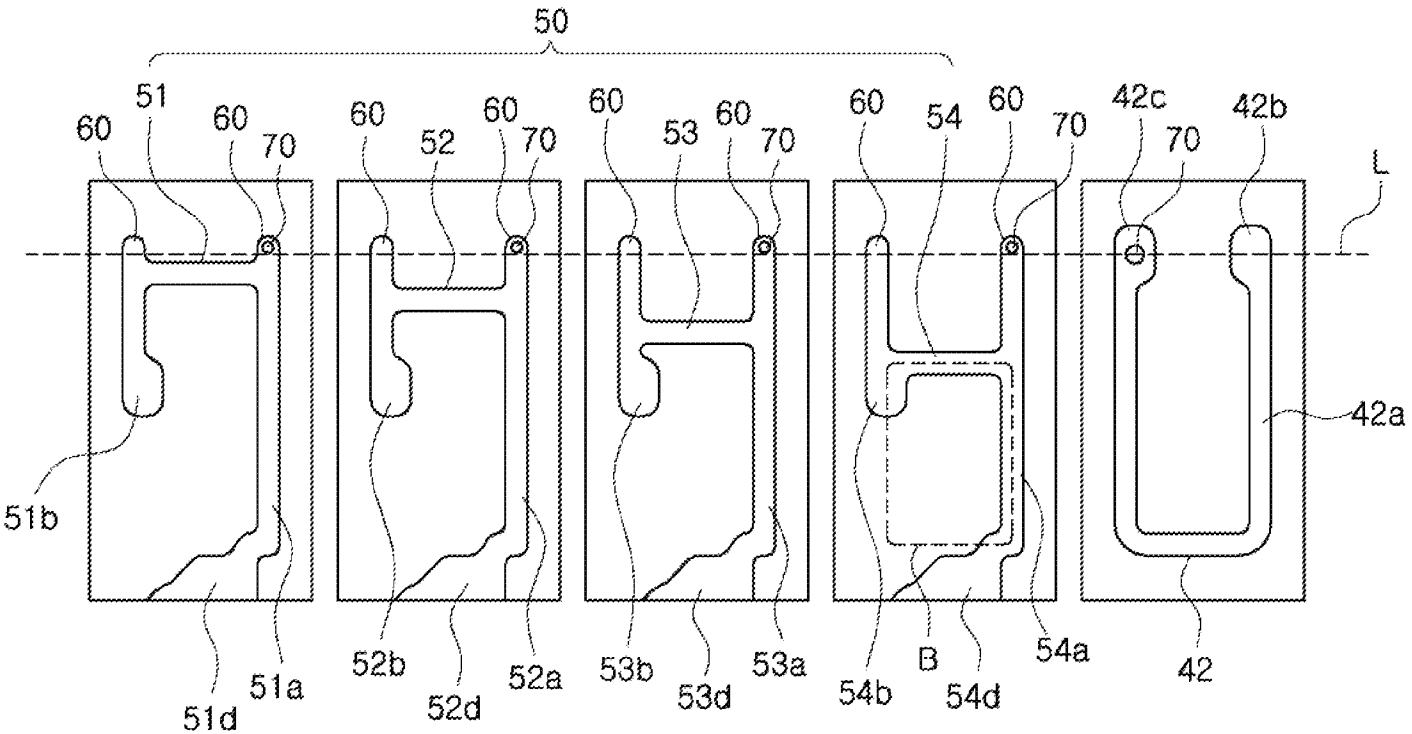
FIG. 5, which schematically illustrates plan views of second internal electrodes included in the laminated inductor according to the exemplary embodiment in the present disclosure, is a view comparing the presence or absence of connectivity with a U-shaped first internal electrode.

FIG. 5, which schematically illustrates plan views of second internal electrodes included in the laminated inductor according to the exemplary embodiment in the present disclosure, is a view comparing the presence or absence of connectivity with a U-shaped first internal electrode.

Second internal electrodes 51 to 54 may include second inductance portions 51*a* to 54*a*, connection portions 51*b* to 54*b*, and lead electrode portions 51*d* to 54*d*.

The second inductance portions 51*a* to 54*a* may have a tetragonal shape with a pair of long sides and a pair of short sides as a tetragon B represented by a dotted line in FIG. 5. In this case, an internal area of each of the second inductance portions 51*a* to 54*a* may mean an area of the tetragon B.

The internal areas of the second internal electrodes 51 to 54 of FIG. 5 may be different from each other. That is, inductance of the laminated inductor may be adjusted by selecting one from the second internal electrodes 51 to 54 of FIG. 5 to dispose the selected second internal electrode on or below the coil part 40.

According to the present disclosure, the internal area is decreased, which means that one portion of the inductance portion of the second internal electrode is disposed to pass through the same path as that of the inductance portion of the first internal electrode, and another portion thereof is disposed to pass through the interior of the inductance portion of the first internal electrode.

As described above, inductance of the laminated inductor may be finely adjusted by adjusting the internal areas of the second internal electrodes 51 to 54.

In the laminated inductor, in order to adjust inductance, the number of turns of the coil may be adjusted by increasing the number of first internal electrodes laminated in the coil part. However, in this case, the number of turns may be increased, and thus inductance may be rapidly increased.

Therefore, inductance of the laminated inductor may be finely adjusted by adjusting the internal area of the second internal electrode in order to prevent inductance from being rapidly increased as described above.

According to the related art, in a case of adjusting the internal area of the second internal electrode as described above, a problem such as a connection defect may occur depending on the kind of first internal electrode adjacent thereto.

However, since the laminated inductor according to the exemplary embodiment includes a connection electrode portion 60, a connection defect problem may not occur regardless of the kind of first internal electrode adjacent thereto, and thus reliability may be improved.

The connection electrode portion 60 may be extended in a direction opposite to a direction toward lead electrode portions 51*d* to 54*d*. For example, in a case in which the first and second internal electrodes are coils having a tetragonal shape, the connection electrode portion 60 may be extended from at least a portion of corners of a tetragon.

In order to adjust inductance of the laminated inductor, portions of the second inductance portions 51*a* to 54*a* may be disposed to overlap portions of the first inductance portions 41*a* to 46*a*, and the other portions thereof may be disposed to cross the inside of the first inductance portions 41*a* to 46*a*.

In a case of decreasing the internal areas of the second internal electrodes 51 to 54 as described above, the connection electrode portion 60 may be formed at a portion on which the second inductance portions 51*a* to 54*a* are not formed, respectively.

That is, the connection electrode portion 60 may be extended from one portion of the second inductance portions 51*a* to 54*a* of the second internal electrodes 51 to 54 in the direction opposite to the direction toward the lead electrode portions 51*d* to 54*d*, respectively.

For example, when the number of connection electrode portions 60 is two or more, the second internal electrodes 51 to 54 including the connection electrode portions 60 may have an "H" shape, and portions of 4 distal ends of the "H" may be the lead electrode portions 51*d* to 54*d* exposed to the outside of the ceramic body 10.

When the second internal electrodes 51 to 54 including the connection electrode portions 60 have the "H" shape as described above, inductance of the laminated inductor may be adjusted depending on a position of a bar (middle stroke) connecting both sides of the "H".

Figure 7:
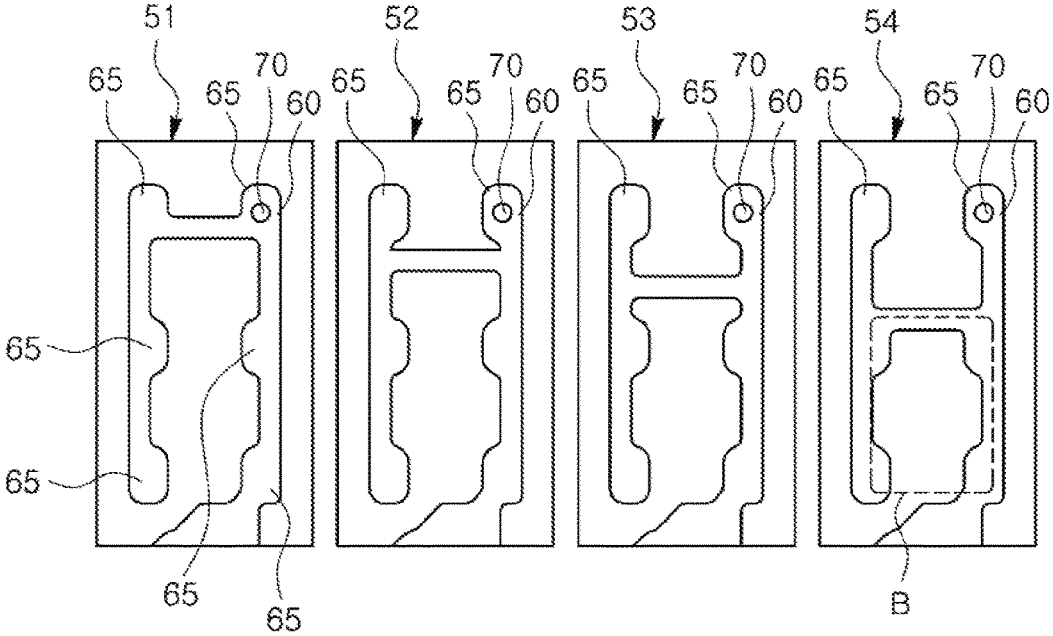
FIG. 7 schematically illustrates plan views of second internal electrodes included in the laminated inductor according to another exemplary embodiment in the present disclosure.

Referring to FIG. 7 to be described below, it may be more clearly appreciated that the second internal electrodes 51 to 54 including the connection electrode portion 60 have the "H" shape.

Further, in a case in which the second internal electrodes 51 to 54 including the connection electrode portion 60 have the "H" shape, the second inductance portions 51*a* to 54*a* may have a "∩" shape having a size smaller than the internal area of the first internal electrode rather than a "⊓" shape. Since the second inductance portions 51*a* to 54*a* have the "∩" shape as described above, connectivity with the first internal electrodes (for example, the first internal electrodes 44 and 45) of which the connection portion is positioned at a left lower end in the plan view may be maintained.

A via 70 may also be disposed on a distal end of the connection electrode portion 60 as in the first and second connection portions 41*b* and 41*c*.

Referring to FIG. 5, when the first internal electrode 42 having the U shape is the uppermost layer or lowermost layer of the coil part 40, connection with the second internal electrode may be secured. A dotted line L connecting the first and second connection portions 42*b* and 42*c* of the first internal electrode 42 meets the connection electrode portion 60 in the plan view. That is, even if the first internal electrode 42 having the U shape is positioned at the uppermost layer or lowermost layer of the coil part 40, connectivity between the first and second internal electrodes may be secured.

Figure 6:
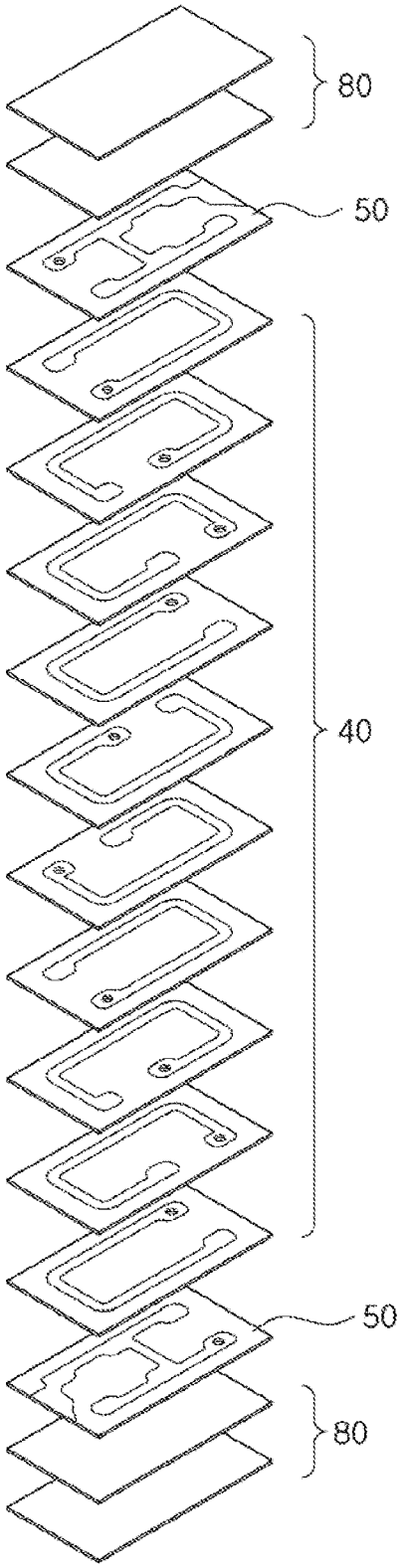
FIG. 6 is an exploded perspective view schematically illustrating a laminated inductor according to another exemplary embodiment in the present disclosure.

FIG. 6 is an exploded perspective view schematically illustrating a laminated inductor according to another exemplary embodiment in the present disclosure, and FIG. 7 schematically illustrates plan views of second internal electrodes included in the laminated inductor according to the present exemplary embodiment.

A description of the same configuration as that of the above-mentioned laminated inductor among configurations of the laminated inductor according to the exemplary embodiment illustrated in FIGS. 6 and 7 will be omitted.

Referring to FIGS. 6 and 7, second internal electrodes 51 to 54 may further include a connection reinforcement portion 65 in addition to a connection electrode portion 60.

The connection reinforcement portion 65 may be disposed at portions of the connection electrode portion 60 and second inductance portions 51*a* to 54*a*. In detail, the connection reinforcement portion 56 may be disposed at positions corresponding to first connection portions 41*b* to 46*b* and second connection portions 41*c* and 46*c* of first internal electrodes 41 to 46 in the plan view.

For example, when the first internal electrodes 41 to 46 have a tetragonal coil shape composed of a pair of long sides and a pair of short sides, the first and second connection portions 41*b* to 46*b* and 41*c* to 46*c* may each be disposed in one corner of a tetragon and central portions of the long sides, and the connection reinforcement portion 65 may be disposed at positions corresponding to the first connection portions 41*b* to 46*b* and the second connection portions 41*c* and 46*c* in the plan view.

The connection reinforcement portion 65 may have a width wider than that of a metal pattern forming the connection electrode portion 60 or the second inductance portions 51*a* to 54*a*.

In the laminated inductor, spiral internal electrodes may be printed on ceramic sheets and laminated, and respective internal electrodes may be electrically connected to each other through a via. A position of a connection portion may be misaligned during the printing and laminating, described above, and thus a connection defect may occur.

Since the laminated inductor according to the present exemplary embodiment has the connection reinforcement portion 65 having a width wider than that of the metal pattern forming the connection electrode portion 60 or the second inductance portions 51*a* to 54*a*, however, the above-mentioned connection defect that may occur during a manufacturing process of the laminated inductor may be prevented. That is, the connection reinforcement portion 65 according to the present exemplary embodiment may improve the reliability of the laminated inductor.

As set forth above, according to exemplary embodiments in the present disclosure, other characteristics of the laminated inductor including inductance thereof may be precisely adjusted by adjusting the internal area of the second internal electrode that contacts the external electrode.

Since the laminated inductor according to the exemplary embodiment includes the connection electrode portion on the same plane as the second internal electrode, connectivity between the first and second internal electrodes may be secured, separately from adjusting the internal area of the second internal electrode.

Furthermore, since the laminated inductor according to another exemplary embodiment has the connection reinforcement portion at the positions corresponding to the connection portions of the first internal electrode, connectivity between the first and second internal electrodes may be improved regardless of the shape of the first internal electrode.

While exemplary embodiments have been shown and described above, it will be apparent to those skilled in the art that modifications and variations could be made without departing from the scope of the present invention as defined by the appended claims.

What is claimed is:

1. A laminated inductor comprising:

a ceramic body;

a coil part including a plurality of first internal electrodes including connection portions at both end portions thereof and disposed in the ceramic body in a spiral shape;

a second internal electrode including a lead electrode portion exposed to the outside of the ceramic body, having an internal area smaller than that of the first internal electrode, and disposed on or below the coil part in a spiral shape; and a connection electrode portion extended from the second internal electrode in a direction opposite to the lead electrode portion, wherein the second internal electrode including the connection electrode portion has an "H" shape with a bar connecting two sides of the "H" shape.

2. The laminated inductor of claim 1, wherein the first and second internal electrodes have a tetragonal coil shape, and the connection electrode portion is extended from at least one corner of a tetragon.

3. The laminated inductor of claim 1, wherein the connection electrode portion is electrically connected to the connection portion of the first internal electrode adjacent thereto through a via.

4. The laminated inductor of claim 1, wherein the first internal electrode adjacent to the second internal electrode has a U or ∩ shape.

5. The laminated inductor of claim 1, wherein the connection portions are disposed at a plurality of positions.

6. The laminated inductor of claim 5, further comprising a connection reinforcement portion disposed in the connection electrode portion at positions corresponding to the plurality of connection portions, wherein the connection reinforcement portion has a width wider than that of the second internal electrode or the connection electrode portion.

7. A laminated inductor comprising:

a ceramic body having external electrodes disposed on both sides;

a coil part including a plurality of first internal electrodes having first and second connection portions disposed at first and second end portions thereof, respectively, and a first inductance portion having a coil shape; and a second internal electrode disposed on or below the coil part and including a second inductance portion and a connection electrode portion, wherein an area of the second inductance portion is smaller than that of the first inductance portion, the connection electrode portion is extended from the second inductance portion to a position corresponding to the first or second connection portion adjacent thereto, the second internal electrode including the connection electrode portion has an "H" shape with a bar connecting two sides of the "H" shape.

8. The laminated inductor of claim 7, wherein the first connection portion is connected to the first or second internal electrode positioned thereon through a via, and the second connection portion is connected to the first or second internal electrode positioned therebelow through a via.

9. The laminated inductor of claim 7, wherein the second internal electrode further includes a lead electrode portion, and the second internal electrode is electrically connected to the external electrode through the lead electrode portion.

10. The laminated inductor of claim 7, wherein the second internal electrode further includes a connection reinforcement portion having a width wider than that of the second internal electrode or the connection electrode portion, and the first internal electrode has a tetragonal coil shape composed of a pair of long sides and a pair of short sides, wherein the first and second connection portions are respectively disposed in one corner of a tetragon and central portions of the long sides, and the connection reinforcement portion is disposed at positions corresponding to the first and second connection portions.

* * * * *